US005557307A

United States Patent [19]

Paroff

[11] Patent Number: 5,557,307

[45] Date of Patent: Sep. 17, 1996

[54] CONTINUOUS CLEANING THREAD FOR INKJET PRINTING NOZZLE

[75] Inventor: Paul J. Paroff, East Amherst, N.Y.

[73] Assignee: Moore Business Forms, Inc., Grand Island, N.Y.

[21] Appl. No.: 277,075

[22] Filed: Jul. 19, 1994

[51] Int. Cl.[6] ..... B41J 2/165

[52] U.S. Cl. ..... 347/34; 347/44

[58] Field of Search ..... 347/34, 44, 22, 347/33

[56] References Cited

U.S. PATENT DOCUMENTS

| | | | |
|---|---|---|---|
| 3,854,399 | 12/1974 | Keur et al. | 347/34 |
| 3,981,020 | 9/1976 | Takano et al. | 347/34 |
| 4,024,548 | 5/1977 | Alonso et al. | 347/34 |
| 4,340,893 | 7/1982 | Ort | 347/102 |
| 4,380,771 | 4/1983 | Takatori | 347/44 X |
| 4,401,990 | 8/1983 | Aiba et al. | 347/33 |
| 4,411,705 | 10/1983 | Wallace et al. | 347/34 |
| 4,628,331 | 12/1986 | Ishikawa | 347/34 |
| 4,668,959 | 5/1987 | Jochimsen et al. | 347/34 |
| 4,829,318 | 5/1989 | Racicot | 347/33 |
| 4,861,178 | 8/1989 | Reed | 400/719 |
| 5,081,472 | 1/1992 | Fisher | 347/33 |
| 5,115,250 | 5/1992 | Harmon et al. | 347/33 |
| 5,126,765 | 6/1992 | Nakamura | 347/33 |
| 5,202,702 | 4/1993 | Terasawa et al. | 347/33 |
| 5,266,974 | 11/1993 | Koitabashi et al. | 347/33 |

FOREIGN PATENT DOCUMENTS

| | | | |
|---|---|---|---|
| 61-078654 | 4/1986 | Japan | B41J 3/04 |
| 63-009550 | 1/1988 | Japan | B41J 3/04 |

*Primary Examiner*—Joseph W. Hartary
*Attorney, Agent, or Firm*—Nixon & Vanderhye

[57] ABSTRACT

An adsorbent material is mounted on a nozzle plate of an ink jet printer to collect extraneous ink and particles that might otherwise clog the nozzle orifices of the printer. In ink jet printers, ink droplets are propelled from an array of orifices in a nozzle plate in the printer head. During the ink droplet ejection, ink is sprayed or deposited around the orifices. The ink droplets are deposited on a paper web adjacent the nozzle and mist from the droplets drifts back to coat the face of the nozzle plate. This ink coating attracts particles that tend to clog the nozzle orifices. By locating an adsorbent material in close proximity to the nozzle orifice array, the material adsorbs and removes ink coating the nozzle plate before the ink clogs the orifices of the nozzle. A thread is an example of an adsorbent material. The thread slides in a groove across the face of the nozzle plate to draw off the ink coating and particles on the nozzle plate. A thread dispenser bobbin on one side of the printer head supplies clean thread to the printer head and a rewind bobbin on the other side of the printer head draws the thread across the nozzle plate and off the dispenser bobbin.

29 Claims, 2 Drawing Sheets

CONTINUOUS CLEANING THREAD FOR INKJET PRINTING NOZZLE

FIELD OF THE INVENTION

The invention relates to the fields of print nozzles and, in particular, drop-on-demand printer nozzles, such as to ink jet and bubble jet printer nozzles. The invention has particular application to the problems associated with dust, other particles and ink that disrupt and clog these printing nozzles during operation.

BACKGROUND AND SUMMARY OF THE INVENTION

Drop-on-demand ink-jet and bubble-jet printers (collectively referred to as ink jet printers) propel from nozzles fine ink droplets onto a paper substrate adjacent the nozzle. An example of these types of printers is the Cannon nozzles known as BC01 and BC02. By precisely controlling the trajectory and the time of ejection of the ink droplets, the ink jet nozzles print clear dots on paper. To achieve such precise positioning of droplets of ink, ink jet nozzles must provide clear and clean orifices for the droplets to pass through as they fly from the nozzle to the surface of the paper. In a conventional drop-on-demand ink jet nozzle, there is an array of several orifices on the face of the nozzle from which the ink droplets are propelled. During printing, ink is ejected out of selected orifices in the array to form the desired images on the paper. The flight of the ink droplets and especially their impact on the paper surface creates a fine mist of ink that coats the surface of the nozzle. Also, during the ejection of the droplets themselves, extraneous ink is sprayed and deposited adjacent the orifices. This moist ink coating attracts paper fiber, dust, grit and other types of particles that can obstruct the nozzle orifices and block the ink droplets being sprayed from the nozzle. Also, the extraneous ink can build up to such an extent that it blocks the orifices. Accordingly, there is a need to regularly clean the nozzle plate of ink jet printers so that the array of orifices remains clear of ink and particles that would otherwise interfere with the printing of ink on the paper.

In the past, ink jet printers have been cleaned by wiper mechanisms that clean the nozzle plates and orifices. Between print jobs, the printer head moves away from the paper web to a cleaning station where is slides against a wiper. These wipers squeegee across the face of the nozzle plate and the openings of the orifices to remove particles that may be obstructing ink in the nozzles. Because the wipers themselves temporarily obstruct the nozzles, the wipers are used only when the ink jet printer is not printing. For example, a wiper may be positioned at the far edges of a carriage path, beyond the edges of the paper held adjacent the carriage path. An example of a wiping system is disclosed in U.S. Pat. No. 5,126,765, entitled "Ink Jet Recording Apparatus Having Cleaning Means For Cleaning A Recording Head". Wipers have proven generally acceptable for desk top printing applications where each individual print job is relatively short and the times between when the print nozzles are wiped clean are relatively brief. In a typical desk-top ink-jet printer the carriage with the ink jet printing head can be shifted to a cleaning station after each print operation. Thus, in the usual desk top application, the printing nozzles are cleaned frequently by conventional wipers and tend not to clog with particles.

With continuous web-feed printing, the print nozzle is required to constantly print for many hours. This is unlike typical desk-top printing applications in which each printing operation is conducted in a relatively short period of time. Shifting the print head to a cleaning station away from the paper to be printed necessarily interrupts the printing operation of a continuous printer. While these interruptions do not substantially interfere with typical desk top print jobs, they do interfere with commercial printing of continuous webs. In this regard, conventional ink jet print heads have been found to require cleaning for every 30 to 60 minutes of printing. Accordingly, remote cleaning stations for ink jet printers are undesirable for commercial continuous printers because the print operation must be interrupted every one-half hour to one hour to clean the nozzles. Accordingly, there is a long-felt need for an apparatus and method for cleaning an ink jet nozzle without interrupting a print job.

Other prior art techniques for cleaning the nozzle face of an ink printer are to blow air at or around the ink nozzles to blow particles off the nozzle face or prevent particles from adhering to the nozzle face. Some of these techniques have included using ionized air to neutralize the static charges on dust particles that attract the dust to the nozzles. These techniques have achieved only partial success as is reported in U.S. Pat. No. 4,411,706, entitled "Method And Apparatus For Eliminating Dust From Ink Jet Printers." While blowing air at the nozzles can be accomplished while the nozzles are spraying ink, (and thus is more advantageous than wipers), the turbulent air flow caused by the blowers disrupts the trajectory of the ink droplets to the paper. Given that the prior systems for cleaning ink jet nozzles have been less than satisfactory, there has been a long felt-need for a technique for effectively cleaning the nozzles. That need was not fully satisfied until the current invention.

The current invention relates to a technique for cleaning an ink jet nozzle with an adsorbent material, such as a thread, that attracts the dust and paper particles that adhere to the face of the nozzle. Particles attach themselves to the thread and cling to the fibers in a thread. Once caught by the thread, the particles can be removed from the area of the nozzles. A thread is movingly positioned across the face of the nozzle of an ink jet printer. The thread is located proximate to the nozzle array from which the ink droplets are propelled. Dust and paper particles that would otherwise clog the nozzle array are caught on the thread before they obstruct the orifices of the nozzle. A dispenser and rewind bobbin arrangement slides the thread in a line(s) across the face of the nozzle to remove the portions of the thread coated with particles and supply clean thread to the nozzle array. By continuously sliding the thread across the nozzle face, ink, grit and paper particles can be continuously captured and removed from the nozzle array. In addition, the ink printer can print while the thread is moving because the thread does not obstruct the ink droplet path from the nozzles to the paper. Accordingly, the current invention provides a technique and apparatus for continually removing particles from an ink jet printer face while printing continues.

In one embodiment, the invention is an ink jet printer head comprising a nozzle plate having an array of orifices through which ink droplets are ejected in a controlled fashion and an ink adsorbent element positioned on said plate in proximity to the array of orifices. In a second embodiment, the invention is a method for cleaning an ink jet printing head having a nozzle plate, an array of orifices in the plate and an ink adsorbent material mounted on the plate proximate to the orifices, wherein the method includes the steps of (a) propelling ink from the orifices of the nozzle plate towards a web for printing on the web; (b) coating the nozzle plate with ink mist and particles while the ink is being propelled from the orifices, and (c) adsorbing at least some of the ink and particles coating the nozzle plate with the adsorbent materials while the ink is being propelled from the orifices.

An object of the current invention is to clean the nozzle array of an ink jet printer and prevent ink, dirt and paper particles from obstructing the orifices of the nozzle array. In this regard, it is a further object of the invention to continually capture and remove ink and particles from the nozzle array while the nozzles are printing. A further object of the invention is to extend the period of maintenance free printing for ink jet printers and to reduce the amount of off-printing cleaning required for ink jet printers. Moreover, another objective of the invention is to enhance the print quality of ink jet printers by overcoming many of the problems caused by extraneous, girt and paper particles that have clogged prior ink jet printers. These and other objectives are achieved by the invention that is shown and described in detail below.

BRIEF DESCRIPTION OF THE DRAWINGS

The invention will be explained in greater detail with reference to the drawings identified as follows.

DETAILED DESCRIPTION OF THE PREFERRED EMBODIMENT

Figure 1:
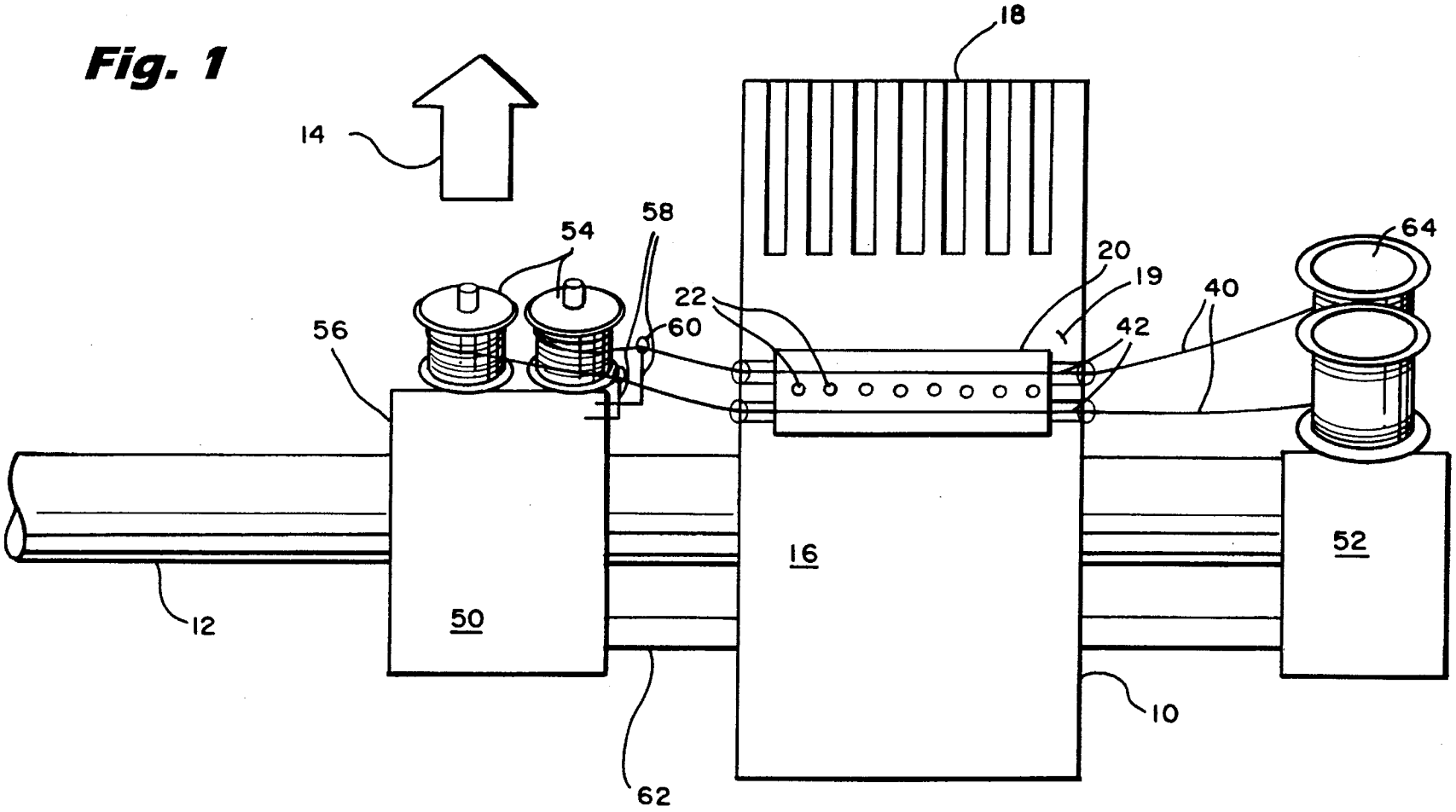
FIG. 1 is a diagrammatic view of an ink jet printer head carriage with an associated thread or tape dispensing bobbin mechanisms.

FIG. 1 shows an ink jet printer head 10 mounted as a carriage on a shaft 12 in a printing mechanism. In particular, the printing mechanism may be an otherwise conventional continuous web-feed printer, for high volume computer printing. It is common for the web speed in such printers to be 300 feet per minute and have an operating speed range of 200 to 400 web-feet per minute. In addition, these printers operate continuously and will typically print for periods as long as twelve hours without interruption.

The paper or other substrate path, as shown by directional arrow 14, is directly in front of and generally parallel to the ink jet printer head. The printing mechanism includes conventional web handling devices to move the web at a predetermined speed, in a precisely controlled fashion and along a predetermined path. The shaft, 12 confines the ink jet printer head to a path perpendicular to the web path 14 and parallel to the plane of the web substrate that is about to received ink droplets during printing. The ink jet printer head is attached to the shaft by a bracket 16 that is slidably mounted on the shaft, and moved back and forth across the shaft in a controlled fashion, to position the printer head with respect to the moving web. The bracket also includes fins 18 that dissipate heat away from the ink jet printer head. A thermocouple may be attached to the root of a heat fin to sense the temperature of the printer head. The bracket may be formed of aluminum or any other material that is suitable for securely holding the ink jet nozzle assembly.

Figure 2:
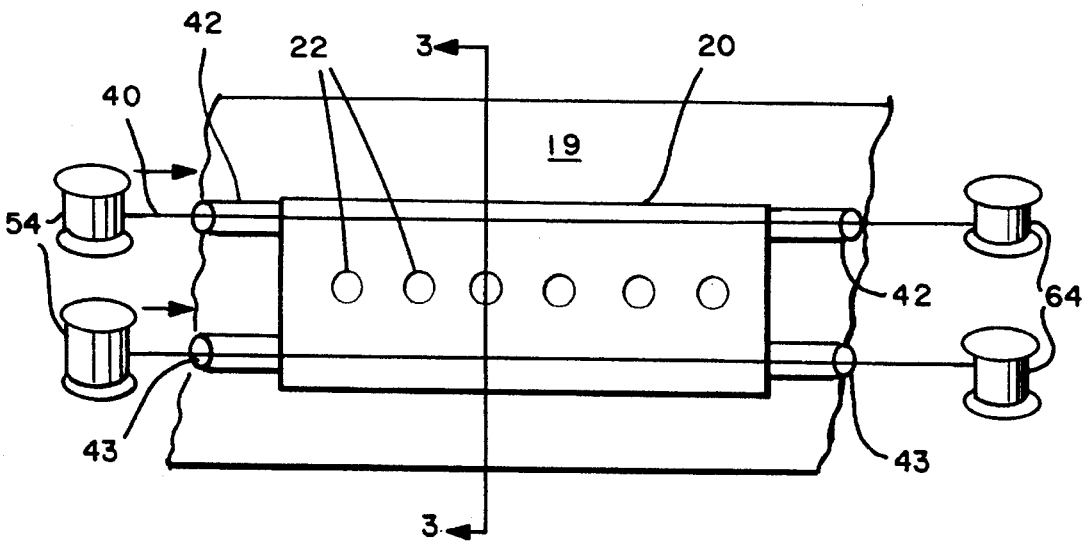
FIG. 2 is a close-up diagrammatic view of the face of a nozzle array in an ink jet printing head with associated cleaning threads shown with schematic representations of thread bobbins.
Figure 3:
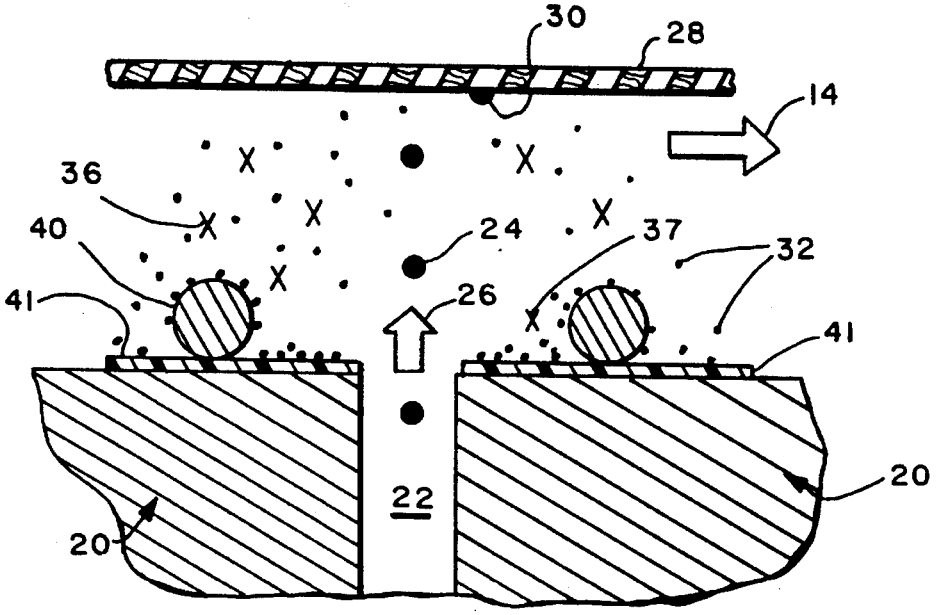
FIG. 3 is a cross-sectional view along section 3—3 of FIG. 2 that shows a schematic representation of an ink orifice in a nozzle array with adjacent cleaning threads.

The ink jet nozzle assembly includes a mounting plate 19 that positions a nozzle plate 20 in the bracket and in close proximity to the paper web to be printed. The mounting and nozzle plates are generally conventional, except that the nozzle plate may be made of machined copper and the mounting plate includes grooves for a cleaning thread that is described more fully below in connection with FIG. 2. An array of nozzle orifices 22 is arranged in the plate. The nozzle plate may also include a hydrophilic coating, e.g. Teflon, at and near the area of the orifices 22. Ink droplets 24 are propelled from these orifices in a direction 26 towards the paper web 28 for printing, as is best shown in FIG. 3. As the ink droplets impact on the web, most of the ink remains on the web as dots 30, or other indicia. Some of the ink will splatter as it hits the paper and form a mist of ink particles 32. In addition, there will be some residue of ink mist resulting from the ejection of the ink droplets from the nozzle orifices. This ink mist floats in the vicinity of the nozzle plate and paper web, and tends to settle on the nozzle plate, among other surfaces, as an ink coating 34 that builds in thickness as ink printing continues.

The impact of the ink droplets, movement of the paper web and other factors cause paper fibers and other fine particles 36 to dislodge from the web and other surfaces and float in the ink mist. As does the ink mist, some of these particles settle on the nozzle plate and contribute to the build-up 37 of ink and particles in the vicinity of the ink-jet nozzles. If this build-up is permitted to continue without being removed by cleaning, the build-up will clog the nozzle orifices 22 and disrupt printing of the ink. The current invention is a technique for removing some of the ink and particle build-up surrounding the nozzle orifices while printing continues.

It has been found that by locating a thread 40 or other absorbent material near the nozzle orifices, the ink and particles coating the nozzle plate will cling to the absorbent material rather than continually building up on the nozzle plate. In one embodiment, the thread 40 is a continuous filament Rayon thread, such as is manufactured by Coats and Clark Inc. from a continuous Rayon yarn and is approximately 0.008 inches in diameter. Similarly, a ribbon or flat tape made from adsorbent materials could be substituted for the thread. It is preferred that the thread, ribbon or tape (collectively referred to as thread) be sufficiently thin, e.g., 0.008 inches, so as to not touch the paper web adjacent the nozzle plate and that the ribbon or tape have a width in the range of 0.020 to 0.200 inches.

The thread may alternatively be made of a hydrophilic material, such as Teflon or other non-stick material, to attract ink coating the nozzle plate. By positioning a hydrophilic thread a few thousandths of an inch away from the nozzle orifices 22, the thread will draw away the ink coating the nozzle plate area surrounding the orifices without interfering with the printing of ink from the nozzles. Furthermore, a hydrophilic coating 41, such as Teflon or other nonstick material, may be applied to the nozzle plate at and in the vicinity of the orifices and the thread so as to draw ink away from the orifices and to the threads.

In addition, the thread may be formed of materials other than Rayon such as Nylon, Nylon hydrofil, cotton, Polyester and blends of these materials. In addition, a fibrous texture to the surface of the thread will assist in capturing the ink and particles. Moreover, any material used to form the thread should have a minimal number of stray and protruding filaments so as to not unduly contribute to the number of stray particles near the ink orifices.

In an embodiment, a pair of threads 40 is positioned on either side of the nozzle orifices 22 on the plate 20. These threads attract and adsorb some of the ink film that coats the nozzle plate and particles that cling to the plate. As the thread picks-up ink and particles, the thread slides across the mounting plate 19 in grooves 42 on the face of the plate. Alternatively, these grooves could extend across the nozzle plate. These grooves are adjacent and parallel to the nozzle orifices and guide the thread along a pair of paths that straddle the array of orifices. Preferably, the grooves should have a depth depending on the thickness of the thread. In one embodiment, the depth of the groove is preferably in the range of 0.5 inches to 0.0005 inches and optimally at 0.005 inch in depth. In addition, eyelets 43 on the mounting plate 19 may be used to guide the thread through the grooves and across the nozzle plate.

As the threads move across the face of the nozzle plate, they remove some of the ink and particle build-up in the vicinity of the nozzle orifices. By removing some of the build-up in a continuous fashion, the thread cleans the face of the nozzle plate so that the ink and particle build-up does not interfere with the printing of ink droplets onto the paper web. Moreover, this removal of ink and particle build-up is accomplished while the ink is being printed onto the web. The movement of the thread across the nozzle plate continues while printing occurs and does not require that printing be stopped to clean the nozzle orifices.

The threads are drawn from a thread dispenser 50 on one side of the printer head 10 and collected in a collector assembly 52 at the other side of the printer head. The dispenser may be any device that stares a supply of thread such that the thread can spool out to the printer head. In one embodiment, a pair of thread bobbins 54 is rotatably mounted on a dispenser carriage 56, stores a supply of adsorbent thread and dispenses a line of thread to the printing head. The thread may be aligned with respect to the printer head by guide brackets 58 mounted on the dispenser carriage and having alinement loops 60 through which the threads pass.

The dispenser carriage may be slidably mounted onto the printer shaft 12 and may be connected to the printer head 10 by a connection bar 62. In this way, the dispenser carriage moves in tandem with the printer head back and forth across the printer shaft. The collector assembly 52 may be mounted with respect to the printer head in a manner similar to the mounting of the dispenser. Alternatively, the collector and dispenser assembly may be stationary if the printer head is also stationary, such as when the array of nozzle orifices extends completely across the width of the paper web. The collector assembly, in one embodiment, is a pair of thread bobbins 64 that are mechanically rotated at certain speeds to pull the threads across the nozzle plate of the printer head and wind-up the ink saturated threads. The speed at which the threads are drawn across the face of the nozzle plate is determined on an individual basis for each printer and is dependent on the rate at which ink builds up on the nozzle plate and the rate at which ink is adsorbed by the threads.

The invention has been described in what is considered to be the most practical and preferred embodiment. The invention is not limited to the disclosed embodiment(s), but covers various modifications and equivalent arrangements included within the spirit and scope of the appended claims.

What is claimed is:

1. An ink jet printer head comprising:

a nozzle plate having an array of orifices through which ink droplets are ejected in a controlled fashion;

an ink adsorbent element positioned on said plate in proximity to the array of orifices, wherein said ink adsorbent element slides across said nozzle plate as ink droplets are ejected from the orifices.

2. An ink jet printer head as in claim 1 wherein said ink adsorbent material is a thread.

3. An ink jet printer head as in claim 1 wherein said ink adsorbent material is a pair of fibrous threads disposed on either side of the array of orifices.

4. An ink jet printer head as in claims 2 wherein said thread slides across said nozzle plate as ink droplets are ejected from the orifices.

5. An ink jet printer head as in claim 1 wherein said printer head includes a recess to receive said adsorbent material.

6. An ink jet printer head as in claim 2 wherein said printer head includes a groove to receive said thread.

7. An ink jet printer head as in claim 1 wherein said ink adsorbent material is formed of one or more of Rayon, Nylon, Nylon hydrofil, cotton, and Polyester.

8. An ink jet printer head as in claim 2 wherein said thread has a diameter of approximately 0.0008 inches.

9. An ink jet printer head as in claim 6 wherein said groove has a depth in the range of approximately 0.05 inches to approximately 0.0005 inches.

10. An ink jet printer for continuous web printing comprising:

a nozzle plate disposed on a printer head in close proximity to said continuous web, said nozzle plate having an array of orifices through which ink droplets travel from the printer head to the web, wherein said nozzle plate becomes at least partially coated with ink mist and particles during printing, an ink affinitive material mounted on said nozzle plate in close proximity to said array of orifices, wherein said affinitive material captures ink and particles that coat the nozzle plate, and wherein the affinitive material slides adjacent the array of orifices as ink droplets are ejected from the orifices.

11. An ink jet printer as in claim 10 wherein said ink affinitive material is a thread.

12. An ink jet printer as in claim 10 wherein said ink affinitive material is a pair of threads disposed on either side of the array of orifices.

13. An ink jet printer as in claims 11 wherein said thread slides across said nozzle plate as ink droplets are ejected from the orifices.

14. An ink jet printer as in claim 10 wherein said printer head includes a recess to receive said affinitive material.

15. An ink jet printer as in claim 11 wherein said printer head includes a groove to receive said thread.

16. An ink jet printer as in claim 10 wherein said ink affinitive material is formed of a hydrophilic material.

17. An ink jet printer as in claim 11 wherein said thread has a diameter of approximately 0.0008 inches.

18. An ink jet printer as in claim 15 wherein said groove has a depth in the range of approximately 0.05 inches to approximately 0.0005 inches.

19. An ink jet printer as in claim 10 further comprising a dispenser for said ink affinitive material on a first side of said printer head and a collector assembly for said adsorbent material on a second side of the printer head.

20. An ink jet printer as in claim 11 further comprising a thread bobbin dispenser attached to a first side of said printer head and a rewind bobbin disposed from a second side of the printer head, wherein said rewind bobbin draws the thread across the printer head and from the bobbin dispenser.

21. A method for cleaning an ink jet printing head having a nozzle plate, an array of orifices in the plate and an ink adsorbent material mounted on the plate proximate to the orifices, the method comprising the following steps:

a. propelling ink from the orifices of the nozzle plate towards a web for printing on the web;

b. coating the nozzle plate with ink and particles while the ink is being propelled from the orifices;

c. adsorbing ink and particles from the nozzle plate with the adsorbent material while ink is propelled from the orifices, and d. the adsorbent material moves across the nozzle plate while ink is propelled from the orifices.

22. A method for cleaning an ink jet printing head as in claim 21 wherein the adsorbent material is a thread and step (c) is practiced by sliding portions of the thread across the nozzle plate to remove the ink and particles adsorbed by the thread.

23. A method for cleaning an ink jet printing head as in claim 22 wherein the nozzle plate includes a groove adjacent the orifices and step (c) is further practiced by sliding the thread in the groove.

24. A method for cleaning an ink jet printing head as in claim 22 wherein a thread dispenser is mounted on one side of the printer head and a thread collector is mounted on a second side of the printer head and step (c) is further practiced by rotating the collector to draw thread across the nozzle plate and from the thread dispenser.

25. An ink jet printer head comprising:

a nozzle plate having an array of orifices from which ink droplets are propelled in a controlled fashion;

an element having an affinity for ink positioned on said plate in proximity to the array of orifices, and the element moving across the plate while ink droplets are propelled from the orifices.

26. An ink jet printer head as in claim 25 wherein said element is hydrophilic.

27. An ink jet printer head as in claim 25 wherein said element is Teflon.

28. An ink jet printer head as in claim 25 wherein said element is formed of a nonstick material.

29. An ink jet printer head as in claim 25 further comprising a hydrophilic coating on said nozzle plate in an area of said nozzle plate proximate to the orifices and adjacent the element.

* * * * *